US006254218B1

(12) United States Patent
Suzuki et al.

(10) Patent No.: US 6,254,218 B1
(45) Date of Patent: Jul. 3, 2001

(54) COLOR INK JET PRINTER

(75) Inventors: Hidenobu Suzuki, Numazu; Yoshihiro Tsujimura, Shizuoka-ken, both of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/379,868

(22) Filed: Aug. 24, 1999

(30) Foreign Application Priority Data

Aug. 28, 1998 (JP) ..... 10-244084

(51) Int. Cl.[7] ..... B41J 2/21; B41J 2/145; B41J 2/15; B41J 2/155

(52) U.S. Cl. ..... 347/43; 347/40; 347/42

(58) Field of Search ..... 347/43, 40, 42

(56) References Cited

U.S. PATENT DOCUMENTS 5,949,453 * 9/1999 Harris et al. ..... 347/43

FOREIGN PATENT DOCUMENTS 58-215351 12/1983 (JP) .
61-63456 4/1986 (JP) .
10-138520 5/1998 (JP) .

* cited by examiner

*Primary Examiner*—Thinh Nguyen
(74) *Attorney, Agent, or Firm*—Frishauf, Holtz, Goodman, Langer & Chick, P.C.

(57) ABSTRACT

A color ink jet printer for forming a color image on a recording medium transported, by ejecting a plurality of colors of ink along a direction intersecting a transportation direction of the recording medium, includes a plurality of ink jet units corresponding to a plurality of colors of ink, each one of which has a plurality of ink jet nozzles arranged along the direction intersecting the recording medium transportation direction, wherein an ink jet nozzle arrangement density in the ink jet unit which uses an ink used most frequently in the plurality of ink jet units is set higher than the arrangement density of the ink jet nozzles of each of the remainder of the plurality of ink jet units.

5 Claims, 4 Drawing Sheets

COLOR INK JET PRINTER

BACKGROUND OF THE INVENTION

The present invention relates to a color ink jet printer for printing color images on a transported recording medium, and more specifically, to a color ink jet printer which is provided with a plurality of ink jet units corresponding to plural colors of ink including black, each one of which is provided with a plurality of ink jet nozzles arranged along a direction intersecting a transportation direction of the recording medium, and can record color images by ejecting plural colors of ink including black in the direction intersecting the transportation direction of the recording medium onto the transported recording medium.

This kind of color ink jet printer has recently begun to be used in place of a conventional, so-called serial type color ink jet printer which can record color images by ejecting plural colors of ink onto a transported recording medium while the ink jet unit provided with a plurality of ink cassettes for plural colors of ink is making a reciprocal movement along the recording medium in a direction intersecting a transportation direction of the recording medium (in a width direction of the recording medium).

This new type of conventional color ink jet printer is widely known by, for example, Jpn. Pat. Appln. KOKAI Publication No. 10-138520, and in comparison with the conventional so-called serial type color ink jet printer, it has following advantages. That is, since it is no longer necessary to reciprocate the ink jet unit to record color images, it can record color images on the recording medium at high speed. In addition, since the size of each of a plurality of ink cassettes combined with the non-reciprocating ink jet unit can be increased, the frequency for replacing ink cassettes is reduced (that is, recording efficiency is high).

Next, referring to FIG. 8, a structure of the new type of conventional color ink jet printer will be schematically explained.

As shown in FIG. 8, the new type of conventional color ink jet printer 10 has a paper sheet cassette 14 removably arranged at a lower part of an inner space of an external housing 12. The paper sheet cassette 14 includes a mounting plate 14*a* on which a large number of paper sheets P are stacked and an urging means 14*b* such as a spring which urges the mounting plate 14*a* upwards. Substantially at a center in the inner space, a rotation drum 16 which rotates at a predetermined speed in a direction indicated by an arrow R is arranged.

From one end of the paper sheet cassette 14, a first transportation unit 18 extends towards a side facing portion of an outer circumferential surface of the rotation drum 16. The first transportation unit 18 includes a pick-up roller 18*a* with which an upper most paper sheet P in the large number of paper sheets urged upwards as described above by the urging means 14*a* in the paper sheet cassette 14 comes in contact and which picks up the uppermost paper sheet P by its rotation, and a resist roller pair 18*b* with which a leading end of the paper sheet P picked up by the pick-up roller 18*a* from the cassette 14 comes in contact.

The first transportation unit 18 is connected at the resist roller pair 18*b* with a branched transportation unit 20 extending from the resist roller pair 18*b* to a paper sheet manual supply opening 10*a* formed at a predetermined position of an outer wall of the external housing 12. The paper sheet manual supply opening 10*a* is usually covered with a paper sheet manual supply lid 22 which is mounted in a predetermined position on the outer wall of the external housing 12 to be rotatable between an open position where the lid 22 is left from the opening 10*a* to open the opening 10*a* and a closed position where the lid 22 covers the opening 10*a* to close the opening 10*a*. In FIG. 1, the paper sheet manual supply lid 22 is arranged in the open position.

The paper sheet manually inserted into the opened paper sheet manual supply opening 10*a* is transported to the resist roller pair 18*b* by a sub pick-up roller 20 arranged close to the paper sheet manual supply opening 10*a* in the inner space of the external housing 12.

At a predetermined position along each of the transportation paths of the first transportation unit 18 and the branched transportation unit 20, a transportation fault (jamming) sensing unit 24 which senses a transportation fault (jamming) of the paper sheet P in the transportation path is arranged.

The rotation drum 16 includes a recording medium holding member (not-illustrated) mounted in a predetermined position on the outer circumferential surface of the drum 16 so as to be movable between a closed position where the holding member is laid on the circumferential surface and an opening position where the holding member is left from the circumferential surface. The holding member (not-illustrated) is opened and closed by a holding member driving unit (not-illustrated)located in the vicinity of the rotation drum 16. The holding member (not-illustrated) is opened by the holding member driving unit (not-illustrated) when it reaches a predetermined rotation angle position as the rotation drum 16 makes the predetermined rotation.

The resist roller pair 18*b* of the first transportation unit 18 supplies the paper sheet towards the opened holding member on the rotation drum 16. The opened holding member is closed by the holding member driving unit (not-illustrated) at a timing when the leading end of the paper sheet reaches a gap between the opened holding member and the outer circumferential surface of the rotation drum 16, so that the leading end of the paper sheet is held at the predetermined position on the outer circumferential surface of the rotation drum 16 by the closed holding member.

Thereafter, as the predetermined rotation of the rotation drum 16 takes place, the paper sheet is pressed against and brought in close contact with the outer circumferential surface of the rotation drum 16 by a pressure roller 16*a* and an electric charging roller 16*b* arranged on the circumferential surface of the rotation drum 16. The pressure roller 16*a* and the charging roller 16*b* are separated from the circumferential surface of the rotation drum 16 after the paper sheet is passed under these rollers 16*a* and 16*b*. At a predetermined position adjacent to the outer circumferential surface of the rotation drum 16, a transportation fault (jamming) sensing unit 16*c* which senses a separation of the paper sheet from the outer circumferential surface of the rotation drum 16 (that is, transportation fault and a cause of jamming) is arranged.

In this embodiment, the rotation drum 16, pressure roller 16*a*, charging roller 16*b*, and the not-illustrated holding member and the holding member driving unit mentioned above form a recording medium holding unit which holds and rotates the paper sheet as the recording medium.

In the inner space of the external housing 12, a recording head 26 is further arranged adjacent to the outer circumferential surface of the rotation drum 16. The recording head 26 is supported by a recording head moving unit 28, and the recording head moving unit 28 can move the recording head 26 between a recording position where the recording head 26 is located closely to the outer circumferential surface of the rotation drum 16 as shown by a solid line in FIG. 1 and a retracted position where the recording head 26 is brought away from the outer circumferential surface of the rotation drum 16 as indicated by a two-dots chain line in FIG. 1. In the recording position, the recording head 26 is close to the outer circumferential surface of the rotation drum 16 by 1 mm or less.

The recording head 26 includes four ink jet units 26C, 26M, 26Y, and 26K arranged at four positions separated from each other with a predetermined distance interposed therebetween along the circumferential direction of the outer circumferential surface of the rotation drum 16. Each of the four ink jet units 26C, 26M, 26Y, and 26K extends in a range substantially corresponding to a width of the rotation drum 16 in a direction along a rotation center shaft 16*d* of the rotation drum 16.

FIG. 9 shows an enlarged view of a portion of the recording head 26, the portion facing the outer circumferential surface of the rotation drum 16. As shown in FIG. 9, each of the four ink jet units 26C, 26M, 26Y, and 26K is constructed by combining independent sections 27 one another in the direction along the rotation center shaft 16*d*. In this combination, each of the independent sections 27 is elongated and they are generally arranged along a straight line with their longitudinal directions being located along the direction along the rotation center shaft 16*d*, but in detail, they are staggered alternately along the straight line.

Each of the independent sections 27 has a large number of ink jet nozzles 27*a* arranged at a predetermined pitch in a portion facing to the outer circumferential surface of the rotation drum 16, and the ink jet nozzles 27*a* of all of the sections of each ink jet unit 26C, 26M, 26Y or 26K are arranged in a range substantially corresponding to a width of the rotation drum 16 in the direction along the rotation center shaft 16*d*. In this conventional example, the predetermined pitch is set in such a manner that the ink jet nozzles 27*a* are arranged at 300 dpi (dots per inch). And the predetermined pitch of a large number of ink jet nozzles 27*a* in each of the four ink jet units 26C, 26M, 26Y, and 26K is the same one another.

It is possible to prepare each of the ink jet units 26C, 26M, 26Y, and 26K with a large number of ink jet nozzles 27*a* easily and at low cost by forming each of the ink jet units 26C, 26M, 26Y, and 26K with a plurality of independent sections 27 and by forming a large number of ink jet nozzles 27*a* in each of a plurality of independent sections 27. This is because the more the length of a member in which a large member of microscopically small ink jet nozzles 27*a* must be formed is large, the more a process for forming a large number of microscopically small ink jet nozzles 27*a* at a predetermined pitch over the length of the member complicate.

The four ink jet units 26C, 26M, 26Y, and 26K are connected to four ink containers 30 provided in the inner space of the external housing 12 through ink supply tubes 32 with ink supply pumps 31 each having a valve function. To the four ink containers 30, ink cassettes 34 containing ink of colors (in this embodiment, black, cyan, magenta, and yellow) corresponding to ink which are used in the ink jet units 26C, 26M, 26Y, and 26K, are removably provided. The recording head 26 can reciprocate in the direction along the rotation center shaft 16*a* of the rotation drum 16 by ½ the pitch between a large number of ink jet nozzles 27*a* of each of the four ink jet units 26C, 26M, 26Y, and 26K.

The ink supply pumps 31 open the ink supply tubes 32 when the four ink jet units are used to form color images, and allows the ink to be automatically supplied by a negative pressure generated in the four ink jet units as a result of ejection of ink from the ink jet nozzles 27*a*, from four ink containers 30 to four ink jet units 26C, 26M, 26Y, and 26K. In this case, the ink jet unit 26*c* ejects the cyan ink, the ink jet unit 26M ejects the magenta ink, the ink jet unit 26Y ejects the yellow ink, and the ink jet unit 26K ejects the black ink.

The ink supply pump 31*s* are used to prevent the ink jet nozzles 27*a* from clogging by forcibly discharging out the ink from the ink jet nozzles 27*a* of the four ink jet units 26C, 26M, 26Y, and 26K.

In the color ink jet printer 10 of this embodiment, the number of rotation of the rotation drum 16 which is necessary to hold the paper sheet supplied to the rotation drum 16 onto the predetermined position on the outer circumferential surface of the rotation drum 16 is 1. And the number of rotation of the rotation drum 16 which is necessary to form a full-color image on the paper sheet held on the rotation drum 16 at the 300 dpi (dot per inch) pixel density (dissolution) based on an image signal sent from electrical control circuit (not illustrated) is 2. In the similar manner, the number of rotation of the rotation drum 16 which is required for forming a full-color image on the paper sheet held on the rotation drum 16 at the 600 dpi (high dissolution) is 4. And the paper sheet on which the full-color image have been formed is separated from the rotation drum 16 while the rotation drum 16 is making further one rotation, and is transported to an outside of the color ink jet printer 10 by a second transport unit later described.

When the recording head 26 forms the full-color image, the recording head 16 forms one half of the full-color image in the direction along the rotation center shaft 16*a* of the rotation drum 16 white the rotation drum 16 makes one rotation. Thereafter, the recording head 26 moves in the direction along the rotation center shaft 16*a* by ½ pitch, and forms the remainder one half of the full-color image in the direction along the rotation center shaft 16*a* of the rotation drum 16 white the rotation drum 16 makes the next one rotation.

That is, when the recording head 26 forms the full-color image on the paper sheet at the 300 dpi pixel density (resolution) while the rotation drum 16 makes two rotations, the recording head 26 makes one reciprocal movement in the direction along the rotation center shaft 16*a* by ½ pitch. When the recording head 26 forms the full-color image on the paper sheet at the high pixel density (high resolution) of 600 dpi while the rotation drum 16 makes 4 rotations, the recording head 26 makes two reciprocal movements in the direction along the rotation center shaft 16*a*.

Consequently, this conventional color ink jet printer 10 requires 4 rotations of the rotation drum 16 to hold the paper sheet on the outer circumferential surface of the rotation drum 16, form the full-color image on the paper sheet at the 300 dpi pixel density, and separate the paper sheet on which the full-color image have been formed from the outer circumferential surface of the rotation drum 16, and in the similar manner, 6 rotations of rotation drum 16 are required for forming the full-color image on one paper sheet at the pixel density of 600 dpi (high resolution).

Assuming the rotation speed of the rotation drum 16 in this case be 120 rpm, this conventional color ink jet printer 10 can form the full-color image of 600 dpi high pixel density (high resolution) at 20 sheets per minute, and in the case of 300 dpi pixel density full-color image, it can form the full-color image on 30 sheets per minute.

The recording head 26 includes an ink catcher 36 which is movable between a retracted position where the ink catcher 26 is left from the portion of the recording head 26 facing the outer circumferential surface of the rotation drum 16 and a covering position where the ink catcher 36 covers the portion of the recording head 26. The ink catcher 36 is arranged in the retracted position while the recording head 26 is located in the recording position as shown by the solid line in FIG. 1, and is arranged in the covering position while the recording head 26 is located at in retracted position as shown by the two-dots chain line in FIG. 1. The ink catcher 36 in the covering position prevents the ink leaking out from the ink jet nozzles 27*a* from soiling the outer circumferential surface of the rotation drum 16. The ink supply pumps 31 operate to prevent the ink jet nozzles 27*a* of the four ink jet units 26C, 26M, 26Y, and 26K from clogging while the ink catcher 36 is arranged in the covering position.

In the ink catcher 36, an ink jet nozzle cleaning device (not-illustrated) is assembled. This ink jet nozzle cleaning device is used while the ink catcher 36 is arranged in the closed position to forcibly and mechanically clean the ink jet nozzles 27*a* after the recording head 26 is used over a long period of time or the recording head 26 is not used over a long period of time.

In the inner space of the external housing 12, the second transportation unit 38 is arranged to extend from a portion in the downstream side of the recording head 26 in the predetermined rotation direction R of the rotation drum 16 in the vicinity of the outer circumferential surface of the rotation drum 16, to the upper wall of the external housing 12. The second transportation unit 38 includes a peeling member (not illustrated) at its base end close to the outer circumferential surface of the rotation drum 16. The peeling member is used for peeling the paper sheet on which the color image have been formed from the outer circumferential surface of the rotation drum 16 and for introducing the peeled paper sheet into the second transportation unit 38.

The holding member (not illustrated) of the rotation drum 16 is opened by the holding member driving unit (not illustrated) at a predetermined rotation angle position immediately before holding member reaches at the base end of the second transportation unit 38 in last one rotation of the rotation drum 16 after the color image is formed on the paper sheet on the outer circumferential surface of the rotation drum 16 as described above by the recording head 26. As a result of this, the peeling member (not illustrated) at the base end of the second transportation unit 38 peels the paper sheet on which the color image have been formed, from the outer circumferential surface of the rotation drum 16 and introduces into the second transportation unit 38.

The second transportation unit 38 includes a plurality of paper sheet transportation roller pairs 38*a* and transportation fault (jamming) sensing units 38*b* at a plurality of positions along the transportation path of the second transportation unit 38.

In this embodiment, the upper wall 12*a* of the external housing 12 can move horizontally between a closed position in which the upper wall covers the upper opening of the external housing 12 as shown in FIG. 1 and an open position in which the upper wall opens a part of the upper opening. While the upper wall 12*a* is arranged in the closed position as shown in FIG. 1, the paper sheet on which the color image have been formed is discharged from an extending end of the second transportation unit 38 onto the upper surface of the upper wall 12*a* in the closed position as indicated by an arrow A.

When the upper wall 12*a* is located in the open position, it is possible to replace four ink cassettes 34 through the part of the upper opening of the external housing 12.

In the conventional color ink jet printer 10 structured as described above, the color of the ink most frequently used is black, and it is frequent that the black ink only is used. This is because characters and figures are most frequently formed.

And in forming images by the black ink which is most frequently used, it is strongly desired to improve the image forming quality (that is, pixel density) without degrading the image forming speed (that is, the speed for forming the image per unit time), or to improve the image forming speed (that is, the speed to form the image per unit time) without degrading the image forming quality (that is, pixel density).

Under the above-mentioned circumstances, it is an object of the present invention to provide a color ink jet printer which can improve the image forming quality (that is, pixel density) without degrading the image forming speed (that is, the speed for forming the image per unit time) or to increase the image forming speed (that is, the speed for forming the image per unit time) without degrading the image forming quality (that is, pixel density) in forming the image with only the inks most frequently used, such as black ink only.

BRIEF SUMMARY OF THE INVENTION

In order to achieve the above-mentioned object of the present invention, the color ink jet printer of the present invention for forming a color image on a recording medium transported, comprising:

a plurality of ink jet units corresponding to plural colors of ink, each provided with a plurality of ink jet nozzles arranged along a direction intersecting the transportation direction of the recording medium, wherein an arrangement density of the ink jet nozzles in the ink jet unit which uses an ink used most frequency in the plural colors of inks is set higher than the arrangement density of the ink jet nozzles of each of the remainder of the plurality of ink jet units.

With this structure, when the image is formed on the recording medium by only the ink jet unit which uses the ink used most frequency while the recording medium is transported at a predetermined speed, it is possible to improve the image forming quality (that is, pixel density) while the recording medium is transported at the predetermined speed, as compared to a case when the image is formed by each of the ink jet units or a combination thereof which uses or use each of or the other inks while the recording medium is transported at the predetermined speed.

Alternately, if the quality (that, is the pixel density) of the image formed on the recording medium by the ink jet unit which uses the ink used most frequently is the same as that of the image formed on the recording medium by each of the ink jet units or the combination thereof which uses or use each of or the other inks, it is possible to increase the image forming speed (that is, the speed for forming the image per unit time) without degrading the image forming quality (that is, pixel density) by the ink jet unit which uses the ink used most frequently.

And in the color ink jet printer of the present invention structured as described above, the ink which is used most frequently can be black ink.

In the color ink jet printer of the present invention structured as described above, the ink jet unit which uses the ink used most frequently includes a plurality of parts separated each other in the transportation direction of the recording medium, a pitch between the plurality of ink jet nozzles in each of the parts of the ink jet unit in the direction intersecting the transportation direction of the recording medium is substantially the same as the pitch between the plurality of ink jet nozzles in each of the remaining ink jet units in the direction intersecting the transportation direction of the recording medium; and the positions of the plurality of ink jet nozzles of one of the plurality of parts of the ink jet unit which uses the ink used most frequently deviate only by a distance smaller than the pitch from the positions of the plurality of ink jet nozzles of the other part adjacent to the one part in the direction intersecting the transportation direction of the recording medium.

In such a case, it is possible to manufacture the ink jet unit which uses the ink used most frequently with the ease of the same level as that of the ink jet units which use other inks.

And in the above-mentioned case, in order to further improve the image forming quality (that is, pixel density), if the number of the plurality of the above parts of the ink jet unit which uses the ink used most frequently is demoted by N and the pitch between the plurality of ink jet nozzles of each of the plurality of above parts is denoted by Pz, the distance in which each of the plurality of ink jet nozzles of one of the above parts deviates from each of the plurality of ink jet nozzles of the other part adjacent to the one part in the direction intersecting the transportation direction should be preferably specified as Pz/N.

In the color ink jet printer of the present invention as structured as described above, it may be that the pitch between the plurality of ink jet nozzles of the ink jet unit which uses the ink used most frequently in the direction intersecting the transportation direction is set to be smaller than the pitch between the plurality of ink jet nozzles of each of the other ink jet units.

In such a case, as compared to the above described case in which the ink jet unit which uses the ink used most frequently includes the plurality of parts separated from one another in the transportation direction of the recording medium, the structure of the ink jet unit which uses the ink used most frequently can be made still more simple, and the dimensions thereof can be reduced.

In this case, too, in order to improve the image forming quality (that is, pixel density), if the pitch between the plurality of ink jet nozzles of each of the other ink jet units is denoted by Pz, the pitch between the plurality of ink jet nozzles of the ink jet unit which uses the ink used most frequently should be preferably specified as Pz/M (integer).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

Figure 1:
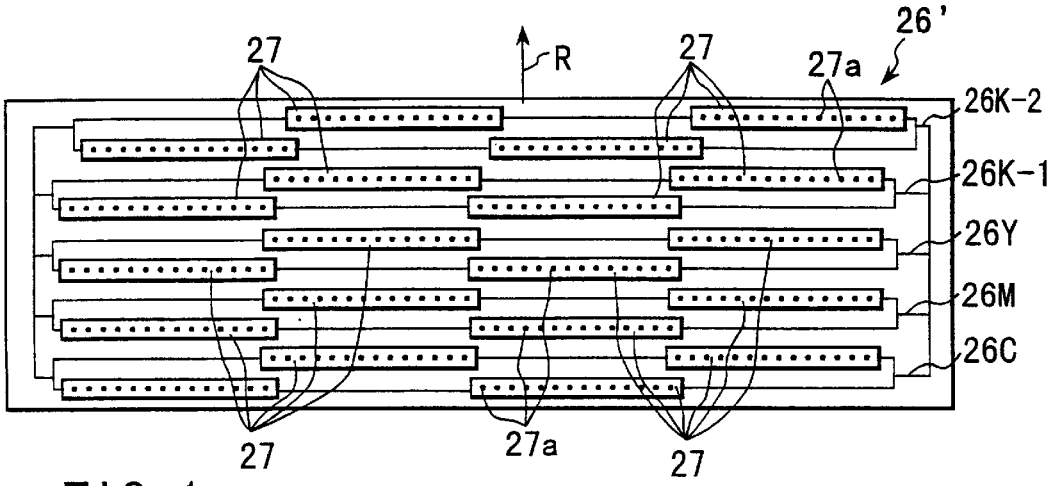
FIG. 1 is a schematic bottom view of a recording head with a characteristic structure in a color ink jet printer according to one embodiment of the present invention.

Referring to the drawings, color ink jet printers according to various embodiments and modified examples of the present invention will be described in detail hereinafter.

DETAILED DESCRIPTION OF THE INVENTION

Figure 8:
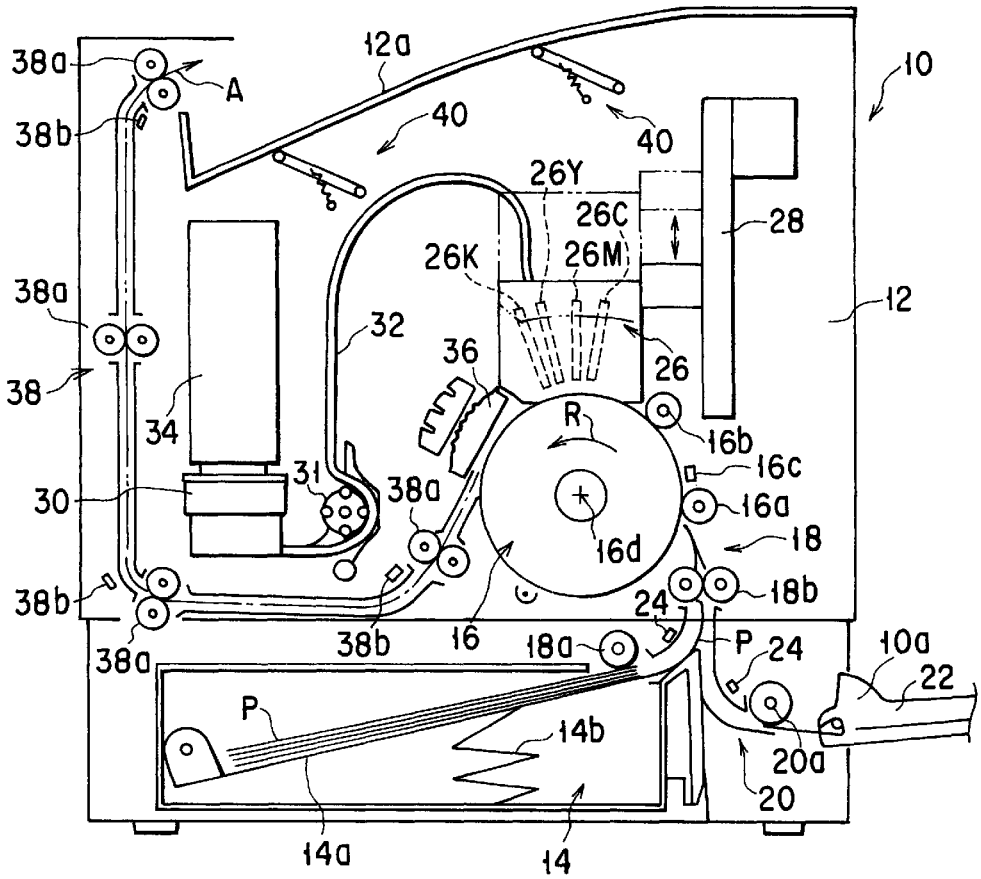
FIG. 8 (PRIOR ART)
FIG. 8 is a schematic vertical sectional view of a conventional color ink jet printer.
Figure 9:
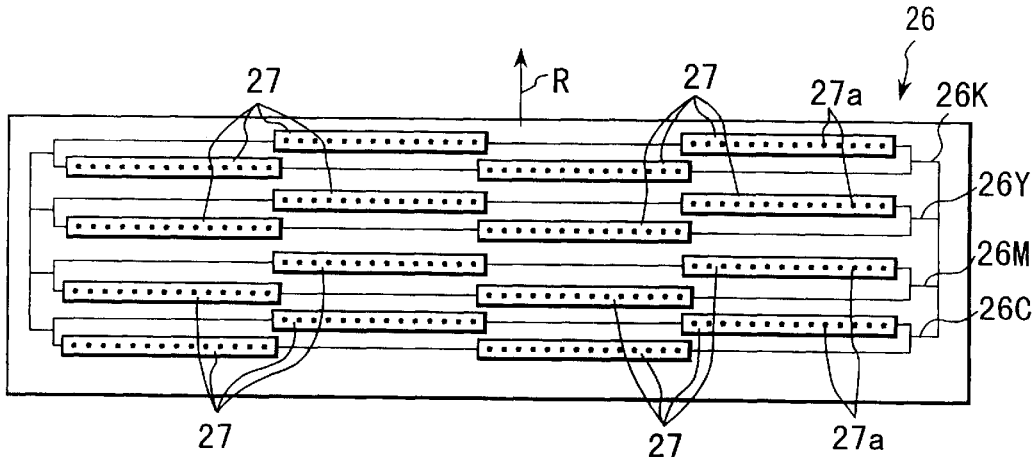
FIG. 9 (PRIOR ART)
FIG. 9 is a bottom view of a recording head of the color ink jet printer in FIG. 8.

A main part of a structure of a color ink jet printer according to one embodiment of the present invention is the same as that of a main part of a structure of the conventional color ink jet printer 10 shown in FIG. 8 and FIG. 9. The color ink jet printer according to the one embodiment of the present invention is different from the conventional color ink jet printer 10 shown in FIG. 8 and FIG. 9 in a structure of the recording head, and more specifically, a structure of the ink jet unit for black ink.

Consequently, with respect to the structure of the color ink jet printer according to the one embodiment of the present invention, the structure of the recording head only will be explained.

Figure 2:
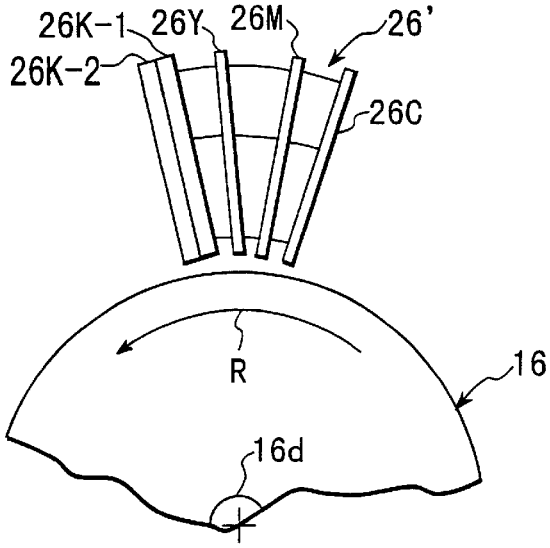
FIG. 2 is a schematic side view of the recording head of FIG. 1.

In FIG. 1 and FIG. 2, a bottom view and a side view of a recording head 26' of the one embodiment are schematically shown, and in these figures, reference characters which are used in FIG. 9 denote the same elements as those of the structure of the conventional recording head 26 in FIG. 9.

The recording head 26' of the one embodiment is provided with three ink jet units 26C, 26M, and 26Y in which are arranged in three positions along the predetermined rotation direction R of the rotation drum 16 and each of which extends in the direction along the rotation center shaft 16*a* of the rotation drum 16, as in the case of the conventional recording head 26. In this case, the three ink jet units 26C, 26M, and 26Y are used to eject three colors of ink, cyan, magenta, and yellow, from a large number of ink jet nozzles 27*a* formed therein, respectively. A structure of each of the three ink jet units 26C, 26M, and 26Y is the same as to one another, and consequently, a pitch between the large number of ink jet nozzles 27*a* in each of the ink jet units is the same as to one another.

In the recording head 26' of one embodiment, unlike the conventional recording head 26, the ink jet unit which uses black ink is constructed by assembling two ink jet sub-units 26K-1 and 26K-2 each of which has the same structure as to each other. The structure of each of the two ink jet sub-units 26K-1, 26K-2 is the same as that of each of the three ink jet units 26C, 26M, and 26Y, and consequently, a pitch between a large number of ink jet nozzles 27*a* formed in each of the two ink jet sub-units 26K-1, 26K-2 is the same as the pitch between the large number of ink jet nozzles 27*a* formed in each of the three ink jet units 26C, 26M, and 26Y.

The two ink jet sub-units 26K-1, 26K-2 which use black ink extend in the direction along the rotation center shaft 16*a* of the rotation drum 16 at two positions along the rotation direction R, the two positions being located adjacent to the three positions of the three ink jet units 26C, 26M, and 26Y along the predetermined rotation direction R of the rotation drum 16. The two ink jet sub-units 26K-1, 26K-2 which use black ink are deviated from each other in the direction intersecting the rotation direction R.

Figure 3:
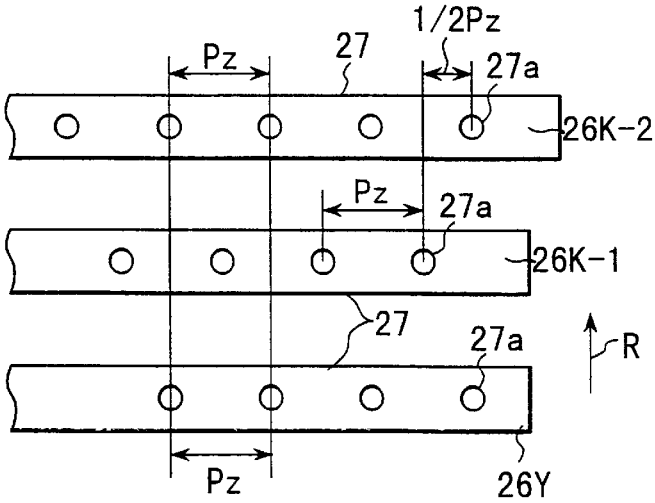
FIG. 3 is an enlarged view of an arrangement of a plurality of ink jet nozzles of a main part of a plurality of ink jet units in the recording head of FIG. 1.

To be more in detail, as clearly shown in FIG. 3, one of the two ink jet sub-units 26K-1, 26K-2 for black ink, for example, 26K-2, is arranged in such a manner that the positions of the large number of ink jet nozzles 27*a* in the direction intersecting the rotation direction R are the same positions as those of the large number of ink jet nozzles 27*a* of each of the three ink jet units 26C, 26M, and 26Y in the direction intersecting the rotation direction R. The other, for example, 26K-1, is arranged in such a manner that the positions of the large number of ink jet nozzles 27*a* in the direction intersecting the rotation direction R deviates in the above intersecting direction from the positions of the large number of ink jet nozzles 27*a* of, for example, 26K-2, in the direction intersecting the rotation direction R.

The distance in which the large number of ink jet nozzles 27*a* of one ink jet sub-unit 26K-1 for black ink deviate with respect to the large number of ink jet nozzles 27*a* of the other ink jet sub-unit 26K-2 for black ink in the direction intersecting the rotation direction R is smaller than the pitch between the large number of ink jet nozzles 27*a* and is ½ Pz in this embodiment.

As described above in detail, in the recording head 26' of this one embodiment, the ink jet unit for black ink is structured by assembling two ink jet sub-units 26K-1, 26K-2, and the two ink jet sub-units 26K-1, 26K-2 are assembled in such a manner that the large number of ink jet nozzles 27*a* of one ink jet sub-unit 26K-1 deviates from the large number of ink jet nozzles 27*a* of the other ink jet sub-unit 26K-2 at the distance smaller than the pitch Pz between the large number of ink jet nozzles 27*a* in the direction intersecting the rotation direction R. As a result, in the recording head 26' of this one embodiment, the arrangement density of the large number of ink jet nozzles 27*a* in the whole of two ink jet sub-units 26K-1, 26K-2 for black ink is higher than the arrangement density of the large number of ink jet nozzles 27*a* of each of other three ink jet units 26C, 26M, and 26Y.

Consequently, in the color ink jet unit printer using the recording head 26' of this one embodiment, the two ink jet sub-units 26K-1, 26K-2 for black ink are able to form a black image at the pixel density (resolution) per one rotation of the rotation drum 16 double as much as that in the case when an image is formed by using at least one of the other three ink jet units 26C, 26M, and 26Y. When the image is formed by the two ink jet sub-units 26K-1, 26K-2 for black ink at the pixel density (resolution) which is the same as that when the image is formed by at least one of the other three ink jet units 26C, 26M, and 26Y, there is required the rotation speed one half that of the rotation drum 16 required when the image is formed by at least one of the other three ink jet units 26C, 26M, and 26Y.

That is, in the color ink jet unit printer using the recording head 26' of this one embodiment, the black image can be formed at the pixel density (resolution) double as much as that when the image is formed by at least one of the other three ink jet units 26C, 26M, and 26Y, if black and other color the images are formed on the same number of paper sheet per unit time as to each other, and the black image can be formed on the greater number of paper sheet per unit time if the black and other color images are formed at the same pixel density (resolution) as to each other.

In this embodiment, both of the two ink jet sub-units 26K-1, 26K-2 for black ink are used only when the image is formed by the black ink only. And when the image is formed with black ink and at least one color ink of at least one of the other three ink jet units 26C, 26M, and 26Y, the ink jet sub-unit 26K-2 for black ink only is used, which has the large number of ink jet nozzles 27*a* arranged in the same way in the direction intersecting the rotation direction R as in the case of the large number of ink jet nozzles 27*a* of each of the other three ink jet units 26C, 26M, and 26Y.

In the above-mentioned embodiment, for black ink, two ink jet sub-units 26k-1, 26K-2 were used, but two or more ink jet sub-units each having the same structure as that of each of the two ink jet sub-units 26K-1, 26K-2, that is, the same structure as that of each of other three ink jet units 26C, 26M, and 26Y, may be used for black ink. In this case, two or more ink jet sub-units are used for black ink are arranged in such a displaced manner as described below in the direction intersecting the rotation direction R. If the pitch of the large number of ink jet nozzles 27*a* in each of the large number of ink jet sub-units is denoted by Pz and the number of the ink jet sub-units used for black ink is denoted by N (integer), the large number of ink jet nozzles 27*a* of one ink jet sub-unit used for black ink are displaced in the direction intersecting the rotation direction R by Pz/N with respect to the large number of ink jet nozzles 27*a* of that ink jet sub-unit used for the black ink and located adjacent to the one ink jet sub-unit.

In the embodiment described above, two ink jet sub-units 26K-1, 26K-2 were used for black ink, but if the ink of the other color is frequently used, the ink jet unit using the ink of the other color may be structured by arranging two or more ink jet sub-units in the same way as in the case of the ink jet unit for the black ink.

Figure 4:
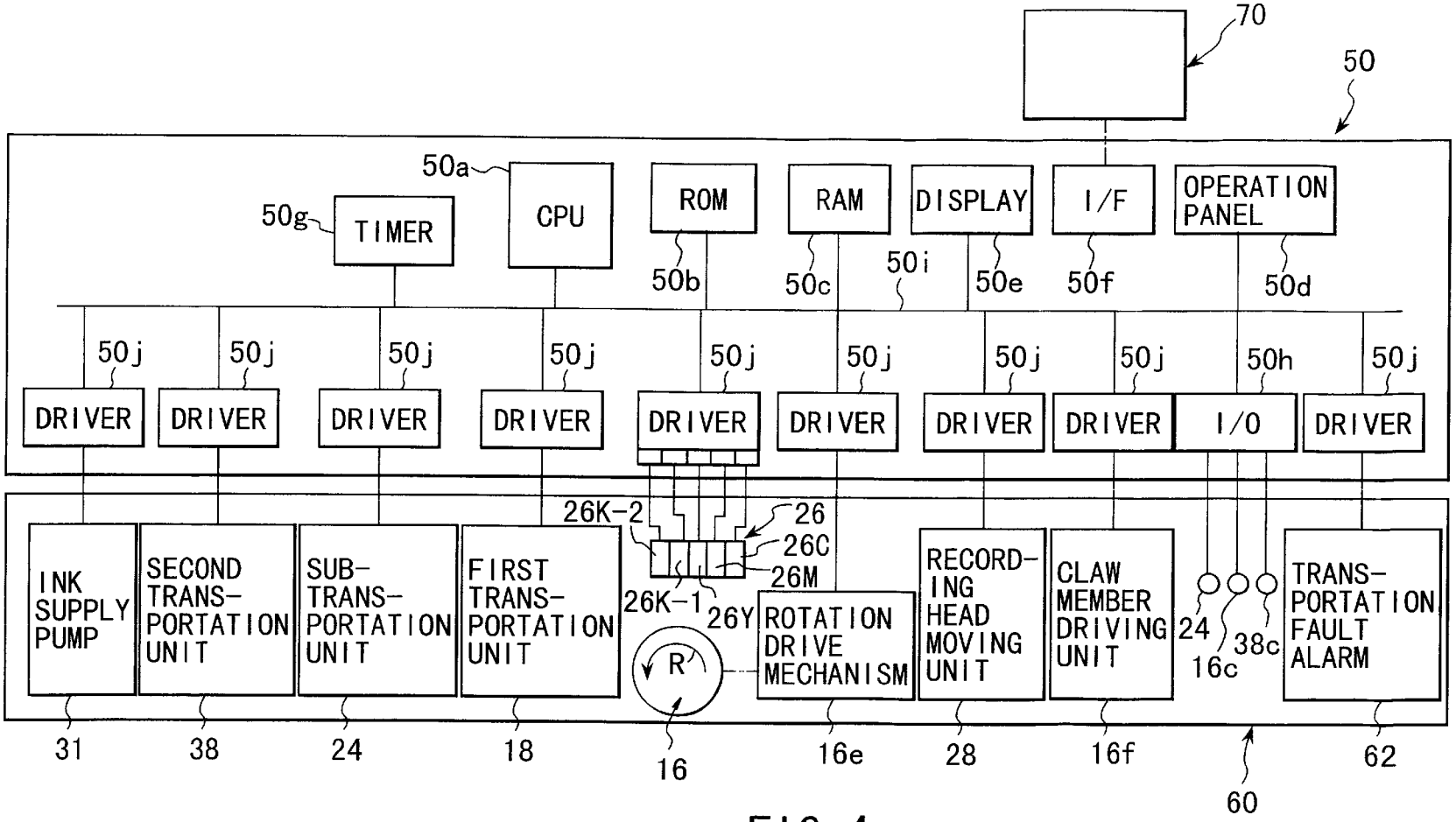
FIG. 4 schematically shows a structure of an electrical control circuit of the color ink jet printer according to one embodiment of the present invention.

Referring to FIG. 4, a structure of an electrical control circuit of the color ink jet printer of the one embodiment as described above will be schematically explained. This electrical control circuit 50 comprises a central processing unit (CPU) 50*a*, a ROM 50*b*, a RAM 50*c*, an operation panel 50*d* and a display 50*e* each of which is arranged on the outer surface of the external housing 12 (see FIG. 8), an interface (I/F) 50*f* for connecting to an external electrical device, a timer 50*g*, and an input/output port (I/O) 50*h*, and these are connected one another by buses 50*i*.

To the input/output port (I/O) 50*h*, the transportation fault (jamming) sensing units 24 for the first transportation unit 18 and branched transportation unit 20 of a mechanical component portion 60 of the color ink jet printer 10, the transportation fault (jamming) sensing unit 16*c* for the rotation drum 16 (that is, for the recording medium holding unit) of the mechanical component portion, and the transportation fault (jamming) sensing units 38*c* for the second transportation unit 38 of the mechanical component portion are connected.

In this embodiment, in the mechanical component portion 60 of the color ink jet printer 10, the rotation drive mechanism 16*e* for the rotation drum 16, the holding member driving unit 16*f* mentioned above for the holding member on the rotation drum 16, the recording head 26, the recording head moving unit 28, the first transportation unit 28, the sub-transportation unit 24, the second transportation unit 38, the ink supply pumps 31, and a transportation fault alarm (for example, a buzzer, an alarm lamp, or a combination of the buzzer and the alarm lamp) 62 are included. And, in the control circuit 50, a plurality of drivers 50*j* are included for the mechanical components as described above. The driver 50*j* for the recording head 26 can operate the plurality of ink jet units and ink jet sub-units 26C, 26M, 26Y, 26K-1, and 26K-2 in the recording head 26 independently from one another.

The transportation fault alarm 62 can make the display 50*e* display transportation fault and display a position where the transportation fault occur.

The image recording device 10 of this embodiment can not only operate based on operation signals inputted through the operation panel 50*d* in the control circuit 50 but also operate based on operation signals inputted from an external appliance, for example, computer 70 connected to the interface (I/F) 50*f*.

Figure 5:
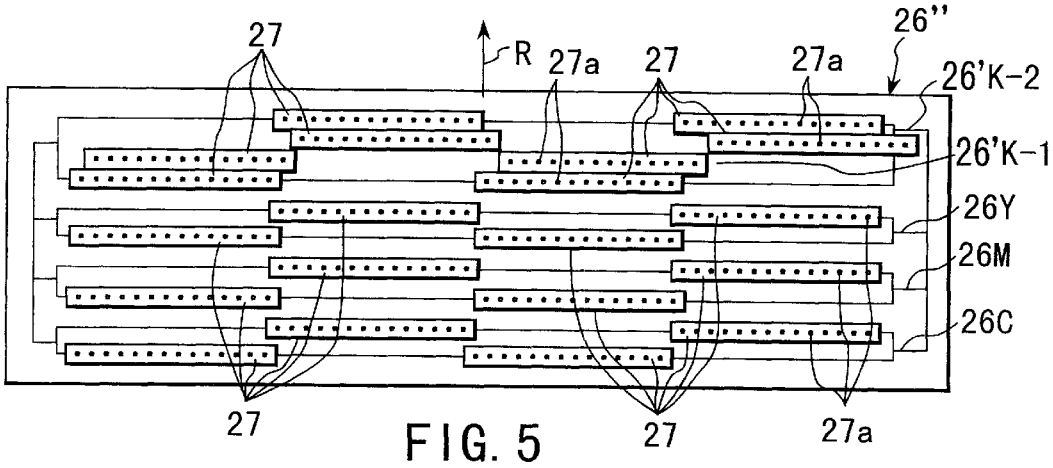
FIG. 5 is a schematic bottom view of a modification of a recording head of a color ink jet printer according to one embodiment of the present invention of FIG. 1.

Referring now to FIG. 5, a modification of the recording head 26' of the one embodiment of the present invention described above with reference to FIG. 1 through FIG. 3 will be explained. The recording head 26" of the modification is different from the recording head 26' of the one embodiment in the structure of each of the two ink jet sub-units 26'K-1, 26'K-2 for black ink.

Each of the two ink jet sub-units 26'K-1, 26'K-2 of the recording head 26" of the modification has a plurality of sets, each set comprising two sections 27 each of which has a large number of ink jet nozzles 27*a*, arranged along the direction intersecting the rotation direction R with a predetermined distance therebetween. And in each of the sets, two sections 27 are connected each other in such a manner that the large number of ink jet nozzles 27*a* of one section 27 are displaced in the direction intersecting the rotation direction R by ½ pz with respect to the large number of ink jet nozzles 27*a* of the other section 27. In addition, the two ink jet sub-units 26'K-1, 26'K-2 are combined each other in such a manner that the plurality of sets of sections 27 of one ink jet sub-unit 26'K-2 are arranged in a clearance between the plurality of sets of sections 27 of the other ink jet sub-unit 26'K-1, in other words, in the clearance between the plurality of sets of sections 27 of the one ink jet sub-unit 26'K-2, the plurality of sets of sections 27 of the other ink jet sub-unit 26'K-2 are arranged.

The recording head 26" of the modification structured in this way functions in the same manner as in the case of the recording head 26' described above with reference to FIG. 1 through FIG. 3. But, the size of the recording head 26" in the direction along the rotation direction R can be smaller than the size of the recording head 26' described above referring to FIG. 1 through FIG. 3 in the direction along the rotation direction R.

Figure 6:
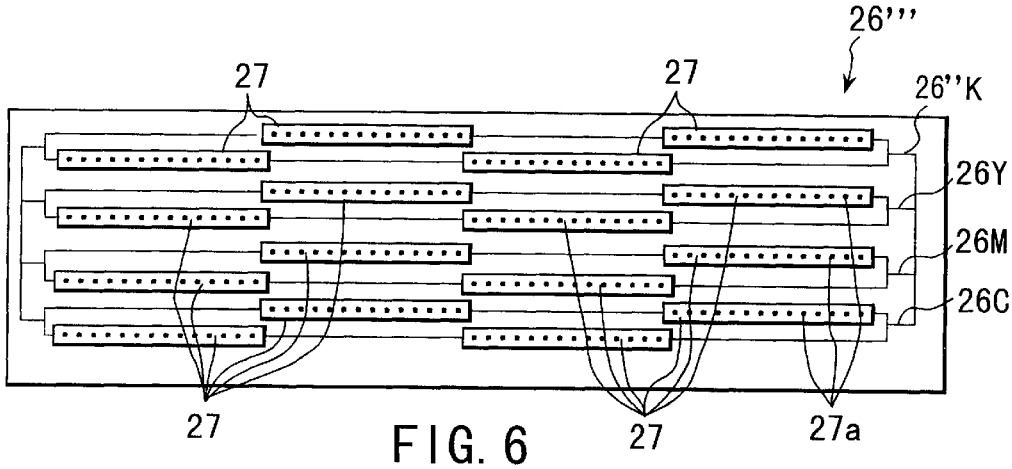
FIG. 6 is a schematic bottom view of a recording head with a characteristic structure in a color ink jet printer according to another embodiment of the present invention.
Figure 7:
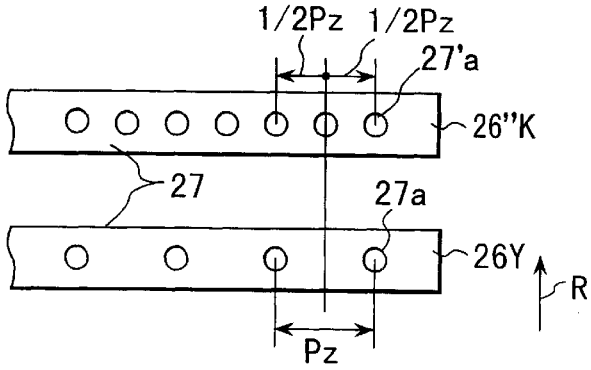
FIG. 7 is an enlarged view of an arrangement of a plurality of ink jet nozzles of a main part of a plurality of ink jet units in the recording head of FIG. 6.

In addition, referring to FIG. 6 and FIG. 7, a structure of a recording head 26'" of another embodiment of this invention will be explained. The recording head 26'" of another embodiment is different from the recording head 26' of the one embodiment in the structure of the ink jet unit for black ink. This recording head 26'" includes one ink jet unit 26"K for black ink. An outer appearance of this ink jet unit 26"K for black ink is the same as that of one ink jet unit 26K for black ink in the conventional recording head 26, and the ink jet unit 26"K has a plurality of sections 27 which are generally arranged in a straight line along the direction intersecting the rotation direction R but are staggered alternately along the straight line.

However, a pitch of a large number of ink jet nozzles 27'*a* formed on each of the plurality of sections 27 of the ink jet unit 26"K for black ink of the recording head 26'" is set to one half the pitch Pz of the large number of ink jet nozzles 27*a* of each of the other three ink jet units 26C, 26M, and 26Y, respectively. The pitch of the large number of ink jet nozzles 27'*a* may be 1/M (integer) of the pitch Pz of the large number of ink jet nozzles 27*a* of each of the other three ink jet units 26C, 26M, and 26Y, respectively.

The color ink jet printer using the recording head 26'" of another embodiment structured in this way allows the ink jet unit 26"K for black ink to form the image with the pixel density (resolution) double as much as that of each of the other three ink jet units 26C, 26M, and 26Y, respectively, while the rotation drum 16 makes one rotation.

In addition, the dimensions of the recording head 26'" of another embodiment is the same as that of the conventional recording head 26 described above referring to FIG. 9, and is far smaller than that of the recording head 26' of the one embodiment described above with reference to FIG. 1 through FIG. 4 or that of the recording head 26" of the modification described above with reference to FIG. 5.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color ink jet printer for forming a color image on a recording medium transported by ejecting a plurality of colors of ink along a direction intersecting a transportation direction of the recording medium, comprising:

a plurality of ink jet units corresponding to a plurality of colors of ink, each one of which has a plurality of ink jet nozzles arranged along the direction intersecting the recording medium transportation direction, wherein an ink jet nozzle arrangement density in the ink jet unit which uses an ink used most frequently in the plurality of ink jet units is set higher than the arrangement density of the ink jet nozzles of each of the remainder of the plurality of ink jet units, wherein the ink let unit which uses the ink used most frequently includes a plurality of parts separated from each other in the transportation direction of the recording medium, wherein a pitch between the plurality of ink jet nozzles in each of the parts of the ink let unit in the direction intersecting the transportation direction of the recording medium is substantially the same as the pitch between the plurality of ink jet nozzles in each of the remaining ink let units in the direction intersecting the transportation direction of the recording medium; and wherein the positions of the plurality of ink jet nozzles of one of the plurality of parts of the ink jet unit which uses the ink used most frequently deviate only by a distance smaller than the pitch from the positions of the plurality of ink let nozzles of the other part adjacent to the one part in the direction intersecting the transportation direction of the recording medium.

2. A color ink jet printer according to claim 1, wherein the ink which is used most frequently is black ink.

3. A color ink jet printer according to claim 1, wherein, if the number of the plurality of the above parts of the ink jet unit which uses the ink used most frequently is denoted by N and the pitch between the plurality of ink jet nozzles of each of the plurality of the above parts is denoted by Pz, the distance in which each of the plurality of ink jet nozzles of one of the above parts deviates from each of the plurality of ink jet nozzles of the other part adjacent to the one part in the direction intersecting the transportation direction should be preferably specified as Pz/N.

4. A color ink jet printer according to claim 1, wherein two or more of the plurality of parts of the ink jet unit which use the ink used most frequently are used when the color ink jet printer forms the color image with only using the most frequently used ink, and one of the plurality of parts of the ink jet unit which use the ink used most frequently is used when the color ink jet printer forms the color image by using the plurality of colors of ink.

5. A color ink jet printer according to claim 1, wherein the plurality of parts of the ink jet unit which use the ink used most frequently are combined with each other in the transportation direction of the recording medium.

* * * * *